United States Patent [19]

Matsumoto

[11] Patent Number: 4,879,981

[45] Date of Patent: Nov. 14, 1989

[54] OIL PUMP DRIVING MECHANISM

[75] Inventor: Eiichi Matsumoto, Yokohama, Japan

[73] Assignee: Nissan Motor Co., Ltd., Yokohama, Japan

[21] Appl. No.: 238,376

[22] Filed: Aug. 31, 1988

[30] Foreign Application Priority Data

Sep. 3, 1987 [JP] Japan ..... 62-135183

[51] Int. Cl.[4] ..... F02B 77/00

[52] U.S. Cl. ..... 123/198 C; 123/196 R; 184/6.28; 417/362; 418/166

[58] Field of Search ..... 123/196 R, 198 C; 184/6.28; 417/362, 364; 418/166

[56] References Cited

U.S. PATENT DOCUMENTS 3,090,322 5/1963 Mettersheimer ..... 418/170

4,295,807 10/1981 Kruger ..... 123/196 R 4,373,483 2/1983 Bury ..... 123/196 R

*Primary Examiner*—E. Rollins Cross

*Attorney, Agent, or Firm*—Pennie & Edmonds

[57] ABSTRACT

A rotor type oil pump is arranged about a leading end of a crankshaft having an annular external gear of the pump concentrically disposed about the leading end. An oil pump driving mechanism is proposed, which comprises a cylindrical portion integrally defined by the leading end of the crankshaft, the cylindrical portion having the same diameter throughout the axial length thereof; and a tubular spacer member coaxially disposed on and splined to the cylindrical portion to rotate therewith, the tubular spacer member having such an external shape as to be latchingly engageable with the annular input member of the oil pump.

15 Claims, 4 Drawing Sheets

OIL PUMP DRIVING MECHANISM

BACKGROUND OF THE INVNENTION

1. Field of the Invention

The present invention relates in general to an oil pump incorporated with an internal combustion engine, and more particularly to an improvement in a driving mechanism through which the oil pump is driven by a crankshaft of the engine.

2. Description of the Prior Art

In order to clarify the task of the present invention, one conventional oil pump disclosed in Japanese Utility Model First Provisional Publication 60-155709 will be described, which is shown in FIGS. 4 to 6 of the accompanying drawings. The oil pump disclosed is of a type which is directly driven by a crankshaft of an internal combustion engine.

FIG. 4 shows a lubrication system of a four cylinder type internal combustion engine 30 to which the oil pump 31 is connected. The oil pump 31 is directly driven by a crankshaft 35 of the engine 30. During operation of the oil pump 31, lublication oil flows in a manner as indicated by the arrows shown in the drawing. That is, during operation, oil in an oil pan (not shown) is pumped up through an oil strainer 32 where large particles are trapped, and the oil from the pump 31 flows to an oil filter 33 where fine particles are trapped, and the oil thus cleaned flows into a main gallery 34 from which the oil is supplied to main bearings of the crankshaft 35 and to crank journals **36*a* to 36*e* of the same. The oil which has lublicated these parts returns to the oil pan. A part of the oil which has been fed to the crank journals 36*a* to 36*e* flows through a passage of the crankshaft 35 to crank pins 37*a* to 37*d* to lublicate the same. A part of the oil which has been fed to the crank pins 37*a* to 37*d* is injected from splay openings of connection rods to lubricate pistons (not shown) in corresponding cylinders. While, a part of the oil which has been fed to the main gallery 34 is fed through a passage 38 to bearings of a cam shaft 39 and then to a rocker shaft 40 to carry out lubrication of a valve mechanism 41 and a distributor 42. The oil from these parts is introduced through oil inlets 43 to 43*c* into interior passages of a cylinder block and then returns to the oil pan. A part of the oil which has been fed to the main gallery 34 is injected from splay openings of a chain tensioner 44 to lubicate a chain 45, and injected from a pipe 46 to lubricate a chain sprocket wheel 47 and the chain 45**. The oil from these parts returns to the oil pan.

As is seen from FIG. 5, the oil pump 31 disclosed by the above-mentioned publication is of a rotor type which comprises an annular body 50, an internal gear 51 rotatably held in the body 50 and an external gear 52 eccentrically received in and partially meshed with the internal gear 51 leaving a crescent member 53 therebetween. The body 50 is formed at the diametrically opposed portions thereof with inlet and outlet ports 54 and 55. The external gear 52 is formed at its central portion with a semicircular bore **52*a* into which a semicircular portion 58 (see FIG. 6) of the crankshaft 35 is snugly and latchingly received. Under operation of the engine 30, the external gear 52 is driven by the crankshaft 35 and the internal gear 51 is driven by the external gear 52, so that oil is forced to flow in a known manner from the inlet port 54 to the outlet port 55** under pressure.

The motion transmittance from the crankshaft 35 to the oil pump 31 is carried out through the parts which are illustrated in FIG. 6. That is, the crankshaft 35 is formed at its leading end with a crank journal portion 56, a sprocket wheel mounting portion 57, a semicircular portion 58 and a pulley mounting portion 59 which are coaxially arranged in this order and the diameters of which are stepwisely reduced in this order, as shown. A chain sprocket wheel 47 is coaxially mounted on the mounting portion 57 and splined to the same. For this splined-connection, the sprocket wheel 47 and the mounting portion 57 have respective key grooves **47*a* and 57*b*. The inner diameter $D_1$ of the sprocket wheel 47, which is substantially equal to the diameter $D_3$ of the sprocket wheel mounting portion 57, is larger than the diameter $D_2$ of the semicircular portion 58 so as to permit insertion of the sprocket wheel 47 onto the mounting portion 57 from the leading end of the crankshaft 35. The sprocket wheel 47 meshes with a drive chain 45 (see FIG. 4) so as to transmit rotation of the crankshaft 35 to a cam shaft 39 at a one half speed reduction. For conformity with the semicircular bore 52*a* of the external gear 52, the semicircular portion 58 of the crankshaft 35** has two diametrically opposed flat portions, as shown.

However, the above-mentioned motion transmitting parts have the following drawbacks due to their inherency in construction.

That is, the chain sprocket wheel 47 is bulky in construction because the same must have an inner diameter $D_1$ greater than the diameter $D_2$ of the semicircular portion 58 which has a considerable size for assuring the motion transmittance therefrom to the external gear 52 of the oil pump 31. Bulky construction of the sprocket wheel 47 causes increase in the number of teeth **47*b* formed thereabout, and thus induces increase in the number of teeth formed about a cam shaft sprocket wheel 39*a* (see FIG. 4) by which the rotation speed of the cam shaft 39 is reduced to one half as compared with that of the crankshaft 35. Employment of these two bulky sprocket wheels 47 and 39*a* causes increase in size of a chain cover on which the oil pump 31** is integrally mounted, and thus the height of the engine is inevitably increased, which counters the general requirement for engine compactness.

SUMMARY OF THE INVENTION

It is therefore an object of the present invention to provide an improvement in a driving mechanism, by which the height of the engine can be reduced.

According to the present invention, there is provided, in an oil pump driving mechanism by which the rotation of a crankshaft of an engine is transmitted to an oil pump which is disposed about a leading end of the crankshaft with an annular input member of the oil pump concentrically disposed therebetween, an improvement which comprises a cylindrical portion integrally defined by the leading end of the crankshaft, the cylindrical portion having the same diameter throughout the axial length thereof; and a tubular spacer member coaxially disposed on and splined to the cylindrical portion to rotate therewith, the tubular spacer member having such an external shape as to be latchingly engageable with the annular input member of the oil pump.

BRIEF DESCRIPTION OF THE DRAWINGS

Other objects and advantages of the present invention will become apparant from the following description when taken in conjunction with the accompanying drawings, in which:

FIGS. 1 to 3 are drawings showing the present invention, in which.

FIG. 1 is a perspective view of essential parts employed in an oil pump driving mechanism according to the present invention;

FIG. 2 is a front view of a tubular spacer which is one of the essential parts of the present invention; and FIG. 3 is a sectional view of a crankshaft at the portion where the essential parts are arranged; and FIGS. 4 to 6 are drawings showing a conventional oil pump driving mechanism, in which:

FIG. 4 is a perspective view of a four-cylinder type internal combustion equipped with the conventional oil pump driving mechanism, showing a lubrication system of the engine;

FIG. 5 is a sectional view of a known oil pump employed in the engine; and

FIG. 6 is a perspective view of essential parts employed in the conventional oil pump driving mechanism.

DETAILED DESCRIPTION OF THE INVENTION

Figure 1:
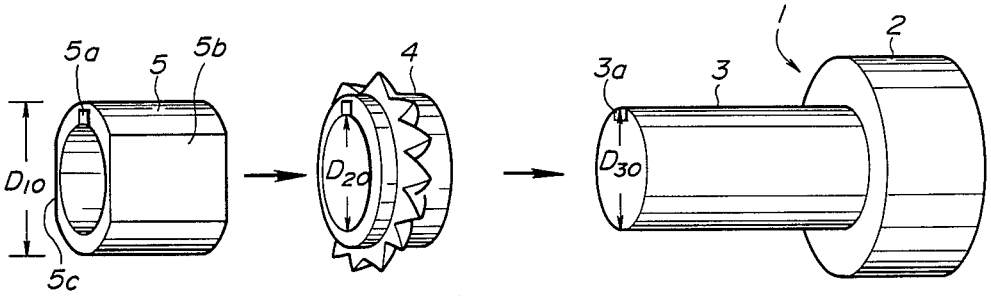
Figure 2:
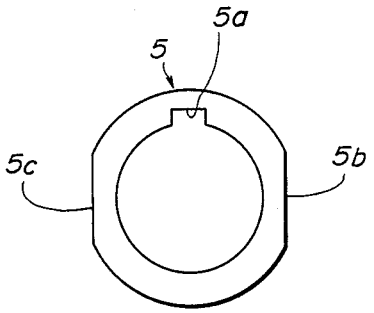
Figure 3:
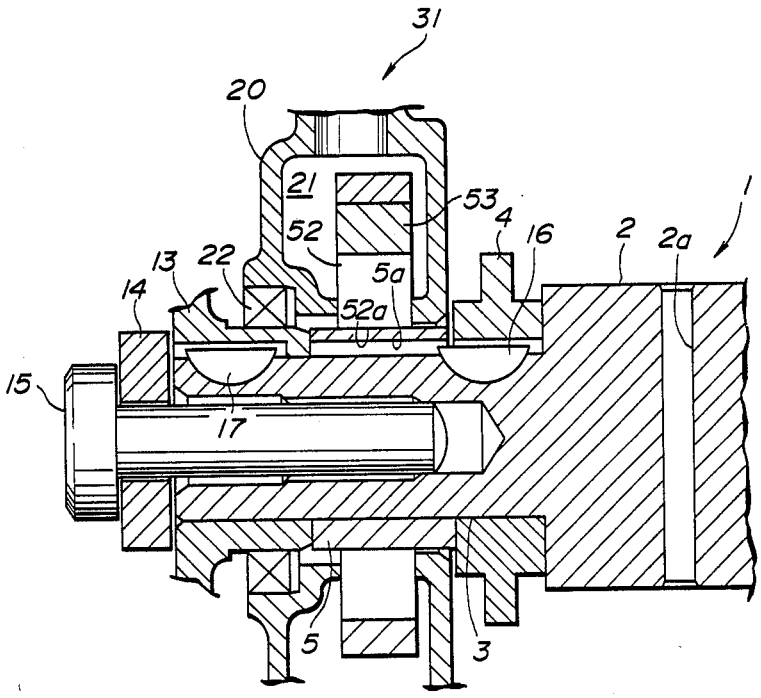

Referring to FIGS. 1 to 3, there is shown an embodiment of the present invention, which is an improved oil pump driving mechanism.

FIG. 1 shows the motion transmitting parts which constitute an essential portion of the oil pump driving mechanism of the invention.

Figure 5:
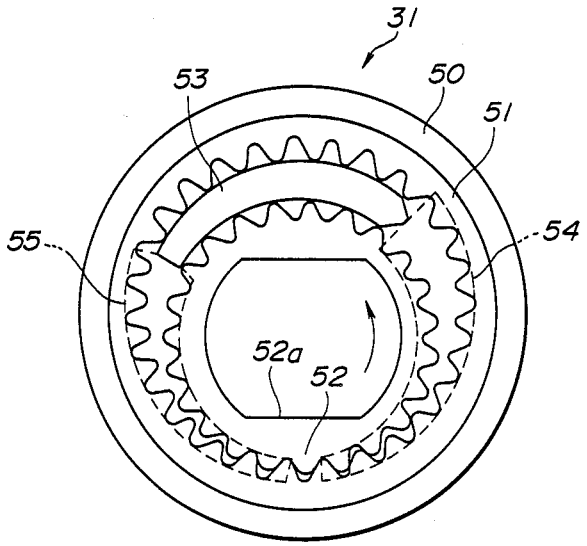
FIG. 5 (PRIOR ART)
Figure 6:
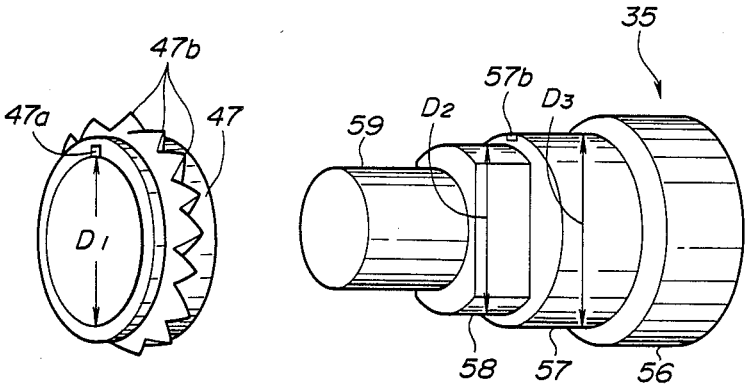
FIG. 6 (PRIOR ART)

Designated by numeral 1 is a crankshaft which is arranged in an engine in the same manner as the above-mentioned crankshaft 35. The crankshaft 1 is formed at its leading end with coaxially arranged larger and smaller diameter portions 2 and 3 which have been machined. The larger diameter portion 2 serves as the crank journal portion. The smaller diameter portion has the same diameter throughout the axial length thereof. As is seen from the drawing, onto the smaller diameter portion 3, there are coaxially disposed and splined both a chain sprocket wheel 4 and a tubular spacer 5 in this order and in tandem fashion. For the splined connection, the smaller diameter portion 3, the sprocket wheel 4 and the tubular spacer 5 have respective key grooves 3*a*, 4*a* and 5*a*. As a matter of course, the inner diameter $D_{20}$ of the sprocket wheel 4 is smaller than the outer diameter $D_{10}$ of the tubular spacer 5. The spacer 5 has an external shape which is in conformity with the semicircular bore 52*a* of the external gear 52 of the aforementioned oil pump 31 (see FIG. 5). Thus, the spacer 5 has diametrically opposed flat portions 5*b* and 5*c*, as shown.

The manner in which the essential parts of the driving mechanism are assembled is shown in FIG. 3. The crank journal portion 2 of the crankshaft 1 is formed with a diametrically extending passage 2*a* for lubricant oil. Onto the smaller diameter portion 3, there are disposed the chain sprocket wheel 4, the tubular spacer 5 and a pulley 13 in this order which are secured to the portion 3 by means of spline keys 16 and 17. In order to hold the parts 4, 5 and 13 in place, a headed bolt 15 is screwed to the leading end of the crankshaft 1 with an interposal of a washer 14 therebetween. The tubular spacer 5 is snugly and latchingly received in the semicircular bore 52*a*of the external gear 52 of the oil pump 31. As has been described hereinafore, the external gear 52 is eccentrically disposed in and partially meshed with the internal gear 51 with the crescent member 53 arranged therebetween. Designated by numeral 20 is a chain cover which defines a pump space 21 for the oil pump 31. Designated by numeral 22 is an oil seal.

Figure 4:
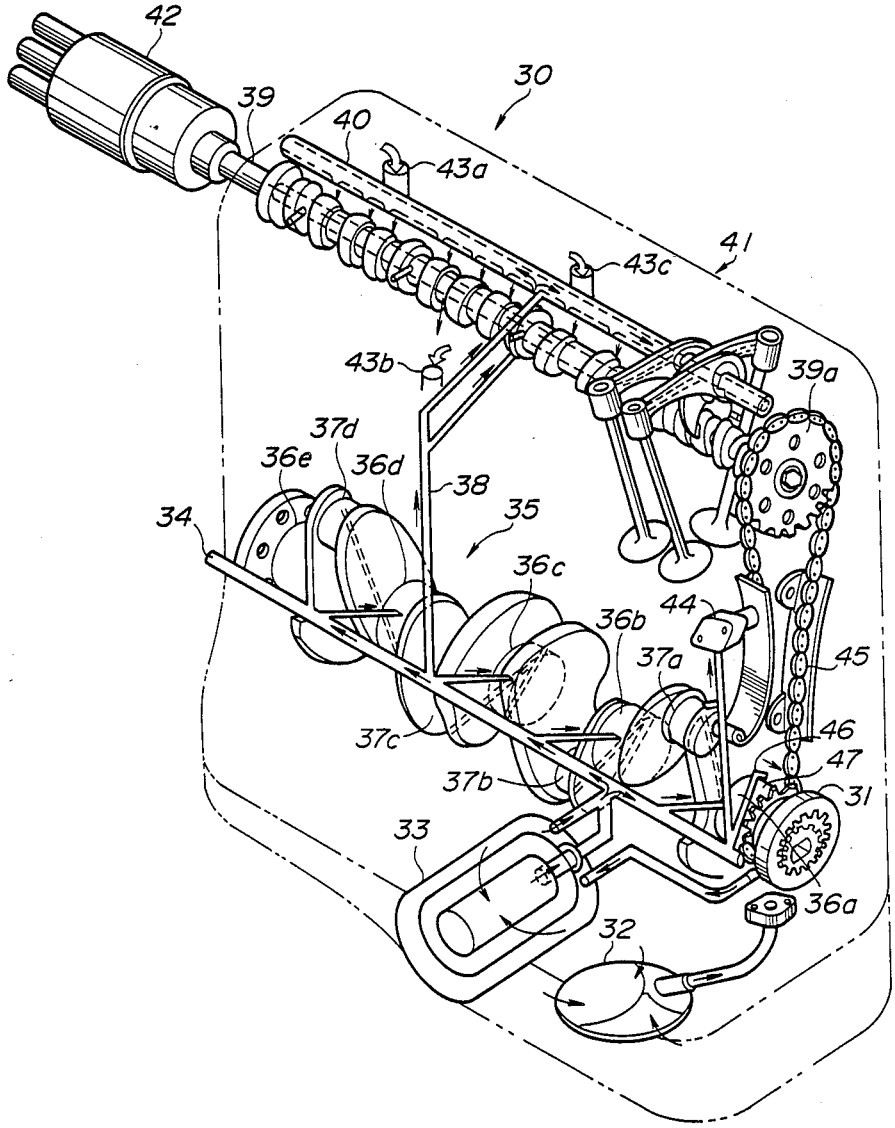
FIG. 4 (PRIOR ART)

When, in operation, the crankshaft 1 is rotated, the rotation is transmitted though the annular spacer 5 to the external gear 52 of the oil pump 31, and at the same time, the rotation is transmitted through the chain sprocket sheel 4, the chain (see FIG. 4) and the cam shaft sprocket wheel 39*a* to the cam shaft 39. With this, the parts of the engine are lublicated by lublicant oil in the afore-mentioned manner and the cam shaft 39 rotates at a half speed as compared with the crankshaft 35.

In the following, advantages of the oil pump driving mechanism of the invention will be described.

Because of the construction as described hereinabove, the chain sprocket wheel 4 can be reduced in size as compared with the sprocket wheel 47 employed in the conventional driving mechanism and thus the number of the teeth formed thereabout can be reduced. This induces reduction in the number of teeth formed about the cam shaft sprocket wheel 39*a*, which is double that of the sprocket wheel 4. Usage of such small-sized sprocket wheels induces reduction in size of the chain cover 20 and thus reduction in height of the engine. This meets the general requirement for engine compactness.

What is claimed is:

1. In an oil pump driving mechanism by which the rotation of a crankshaft of an engine is transmitted to an oil pump which is disposed about a leading end of said crankshaft with an annular input member of said oil pump concentrically disposed therebetween, a cylindrical portion integrally defined by said leading end of the crankshaft, said cylindrical portion having the same diameter throughout the axial length thereof; and a tubular spacer member coaxially disposed on and detachably connected to said cylindrical portion to rotate therewith, said tubular spacer member having such an external shape as to be latchingly engageable with said annular input member of said oil pump.

2. An oil pump driving mechanism as claimed in claim 1, in which said tubular spacer member has at its diametrically opposed outer sides flat portions.

3. An oil pump driving mechanism as claimed in claim 2, in which said cylindrical portion securely mounts thereon a sprocket wheel which meshes with a cam shaft driving chain.

4. An oil pump driving mechanism as claimed in claim 3, in which said sprocket wheel is splined to said cylindrical portion.

5. An oil pump driving mechanism as claimed in claim 4, in which crankshaft is formed at a root part of said cylindrical portion with a crank journal portion the diameter of which is greater than that of said cylindrical portion.

6. A oil pump driving mechanism as claimed in claim 5, in which said cylindrical portion securely mounts thereon a pulley.

7. An oil pump driving mechanism as claimed in claim 6, in which said pulley, said tubular spacer member and said sprocket wheel are held in position by means of a headed bolt which is screwed to said cylindrical portion with an interposal of a washer therebetween.

8. In an internal combustion engine having an oil pump driven by a crankshaft and a cam shaft driven by said crankshaft through a chain mechanism, said oil pump including an annular body, an internal gear coaxially and rotatably disposed in said annular body and an external gear concentrically disposed in and partially meshed with said internal gear, said oil pump being disposed about a leading end of said crankshaft having said external gear concentrically disposed about said leadng end, said chain mechanism including a first sprocket wheel securely disposed on said leading end of said crankshaft, a chain which meshes with said sprocket wheel, and a second sprocket wheel coaxially secured to said cam shaft and meshed with said chain, an oil pump driving mechanism which comprises:

a cylindrical portion integrally defined by said leading end of said crankshaft,said cylindrical portion having the same diameter throughout the axial length thereof; and a tubular spacer member coaxially disposed on and splined to said cylindrical portion to rotate therewith, said tubular spacer member having an external shape which is latchingly engageable with a central bore formed in said external gear of said oil pump.

9. An oil pump driving mechanism as claimed in claim 8, in which said tubular spacer member has at its diametrically opposed outer sides flat portions.

10. An oil pump driving mechanism as claimed in claim 9, in which said cylindrical portion securely mounts thereon said first sprocket wheel.

11. An oil pump driving mechanism as claimed in claim 10, in which said first sprocket wheel is splined to said cylindrical portion.

12. An oil pump driving mechanism as claimed in claim 11, in which crankshaft is formed at a root part of said cylindrical portion with a crank journal portion the diameter of which is greater than that of said cylindrical portion.

13. A oil pump driving mechanism as claimed in claim 12, in which said cylindrical portion securely mounts thereon a pulley.

14. An oil pump driving mechanism as claimed in claim 13, in which said pulley, said tubular spacer member and said first sprocket wheel are held in position by means of a headed bolt which is screwed to said cylindrical portion with an interposal of a washer therebetween.

15. An oil pump driving mechanism as claimed in claim 1, in which said tubular spacer member is splined to said cylindrical portion of said crankshaft.

* * * * *